US009919550B2

(12) United States Patent
Pal et al.

(10) Patent No.: US 9,919,550 B2
(45) Date of Patent: Mar. 20, 2018

(54) RECORDING MEDIUM AND METHOD FOR MAKING THE SAME

(71) Applicant: Hewlett-Packard Development Company, L.P., Houston, TX (US)

(72) Inventors: Lokendra Pal, San Diego, CA (US); Xulong Fu, San Diego, CA (US); Ronald J. Selensky, Poway, CA (US); Joaquin Sanchez Caso, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/907,220

(22) PCT Filed: Jul. 25, 2013

(86) PCT No.: PCT/US2013/051997
§ 371 (c)(1),
(2) Date: Jan. 22, 2016

(87) PCT Pub. No.: WO2015/012833
PCT Pub. Date: Jan. 29, 2015

(65) Prior Publication Data

US 2016/0159127 A1 Jun. 9, 2016

(51) Int. Cl.
*B41M 5/00* (2006.01)
*B41M 5/50* (2006.01)
(Continued)

(52) U.S. Cl.
CPC ..... *B41M 5/502* (2013.01); *B05D 1/00* (2013.01); *B41M 5/506* (2013.01); *B41M 5/508* (2013.01);
(Continued)

(58) Field of Classification Search
CPC .... B41M 5/506; B41M 5/508; B41M 5/5218; B41M 5/5245; B05D 1/00
See application file for complete search history.

(56) References Cited

U.S. PATENT DOCUMENTS 5,955,142 A * 9/1999 Yoshino ..... B41M 5/5218 427/132
6,447,111 B1 9/2002 Gallo et al.
(Continued)

FOREIGN PATENT DOCUMENTS

| | | |
|---|---|---|
| JP | 2000289156 | 10/2000 |
| WO | WO-9963157 | 12/1999 |
| WO | WO-2011053817 | 5/2011 |

OTHER PUBLICATIONS

International Search Report and Written Opinion for International Application No. PCT/US2013/051997 dated Apr. 30, 2014, 11 pages.

*Primary Examiner* — Betelhem Shewareged
(74) *Attorney, Agent, or Firm* — Dierker & Kavanaugh, P.C.

(57) ABSTRACT

A recording medium and a method for making the recording medium are disclosed. The recording medium includes a core substrate. The core substrate includes a base having two opposed surfaces. The base includes from about 40% to about 70% organic material and from about 30% to about 60% inorganic material. The core substrate also includes a mineral coating layer disposed on one or both of the two opposed surfaces of the base. The mineral coating layer has a water-soluble or water-dispersible binder and mineral materials. An adhesion layer is disposed on the mineral coating layer. A surface treatment layer is disposed on the adhesion layer, and the surface treatment layer includes organic fibrous material.

17 Claims, 3 Drawing Sheets

(51) Int. Cl.

| | |
|---|---|
| ***B05D 1/00*** | (2006.01) |
| ***B41M 5/52*** | (2006.01) |
| ***D21H 19/36*** | (2006.01) |
| ***G03G 7/00*** | (2006.01) |

(52) U.S. Cl.
CPC ..... *B41M 5/5218* (2013.01); *B41M 5/5245* (2013.01); *D21H 19/36* (2013.01); *G03G 7/002* (2013.01); *G03G 7/0006* (2013.01); *G03G 7/0013* (2013.01); *G03G 7/0066* (2013.01); *G03G 7/0073* (2013.01); *B41M 5/504* (2013.01); *B41M 2205/34* (2013.01); *B41M 2205/36* (2013.01); *B41M 2205/38* (2013.01)

(56) References Cited

U.S. PATENT DOCUMENTS

| | | | | |
|---|---|---|---|---|
| 6,547,916 | B1 | 4/2003 | Anderson et al. | |
| 6,936,316 | B2 | 8/2005 | Nigam et al. | |
| 8,092,873 | B2 | 1/2012 | Wang et al. | |
| 2001/0021442 | A1* | 9/2001 | Steinbeck | B41M 5/44 503/227 |
| 2001/0029843 | A1* | 10/2001 | Minoru | B01D 46/0001 96/135 |
| 2002/0173583 | A1* | 11/2002 | Shimizu | C08J 5/045 524/515 |
| 2003/0031839 | A1* | 2/2003 | Kohno | B41M 5/52 428/195.1 |
| 2003/0114641 | A1* | 6/2003 | Kelly | C09D 7/125 528/501 |
| 2004/0161556 | A1* | 8/2004 | Nishijima | B41M 5/52 428/32.1 |
| 2004/0265516 | A1 | 12/2004 | Schulz et al. | |
| 2006/0065379 | A1 | 3/2006 | Babcock et al. | |
| 2007/0031615 | A1 | 2/2007 | Nair et al. | |
| 2007/0054111 | A1 | 3/2007 | Yamanaka et al. | |
| 2010/0159164 | A1 | 6/2010 | Zhang et al. | |
| 2010/0310864 | A1 | 12/2010 | Cherukuri | |
| 2011/0008542 | A1 | 1/2011 | Zeng et al. | |
| 2011/0037818 | A1 | 2/2011 | Romano, Jr. et al. | |
| 2011/0050827 | A1 | 3/2011 | Romano, Jr. et al. | |
| 2011/0205287 | A1 | 8/2011 | Zhou et al. | |
| 2017/0095829 | A1* | 4/2017 | Hajakian | B05C 1/0826 |
| 2017/0204567 | A1* | 7/2017 | Yu | D21H 27/002 |

* cited by examiner

RECORDING MEDIUM AND METHOD FOR MAKING THE SAME

BACKGROUND

Media used in laser printing and in inkjet printing often have a weight ranging from about 75 g/m$^2$ (gsm) to about 90 g/m$^2$ (gsm). Coated media generally includes inorganic and organic material in a specific balanced ratio. In conventional media, the inorganic material can only be incorporated up to a certain percentage (e.g., about 10%) due to limitations associated with the paper making machine and in order to maintain media with suitable opacity, strikethrough, and bulk.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

The recording medium disclosed herein has a reduced amount of organic material and an increased amount of inorganic material, which may have environmental advantages. In the examples of the recording medium disclosed herein, it is believed that the amount of organic materials used is reduced by at least 30%, when compared to conventional recording media. The desired ratio of organic to inorganic material is achieved through the use of specific coating(s) and adhesive(s) that are applied to one or both opposed surfaces of a base of a core substrate, where the base contains from about 40% to about 70% organic material and from about 30% to about 60% inorganic material. The layered structures of the examples of the recording media disclosed herein enable the use of significantly higher amounts of inorganic material and significantly lower amounts of organic materials (such as recycled, non-deinkable, unbleached, or mechanical fibers). The increased amount of inorganic material added to the base of the core substrate (which also includes a mineral coating on one or both surfaces of the base), enables a reduced amount of organic material to be used compared to conventional paper media. Without being bound to any theory, it is believed that adding organic fibrous material to a surface treatment layer on the core substrate provides a desired balance between the organic and inorganic materials in the overall recording medium and enables the recording medium to exhibit opacity, strikethrough, and bulk similar to or better than other conventional paper media.

As illustrated in the Example section below, examples of the present disclosure provide a recording medium which exhibits a desirable bulk and a lower strikethrough measurement (which is indicative of a desirable opacity). In an example, the strikethrough is equal to or less than 75 moD and the bulk is equal to or less than 1.25 cm$^3$/g. These properties enable two sided printing on the recording media, while maintaining a desired reduced organic material content.

Figure 3:
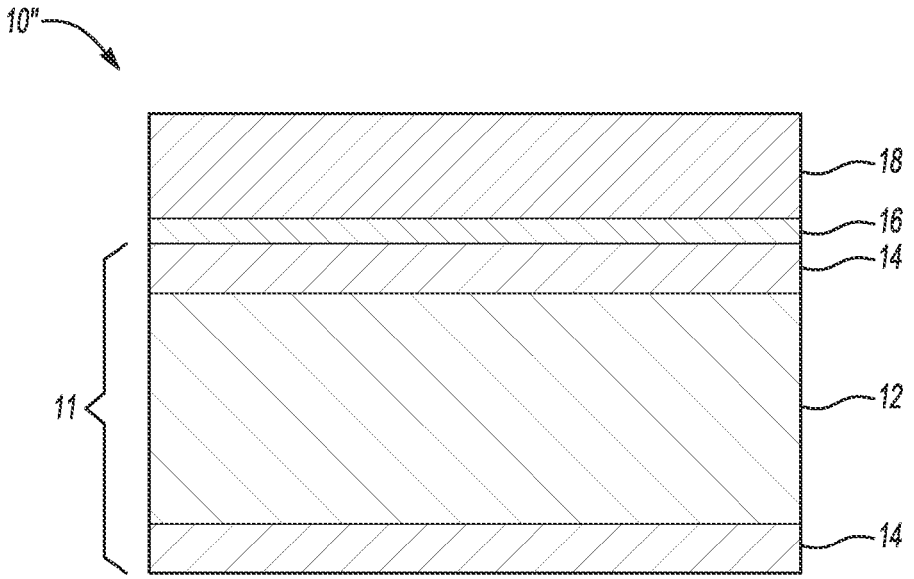
FIG. 3 is a cross-sectional view depicting yet another example of the recording medium, which includes a core substrate having a mineral coating layer on both opposed surfaces of a base, and also includes an adhesion layer and a surface treatment layer disposed on one of the opposed surfaces.
Figure 4:
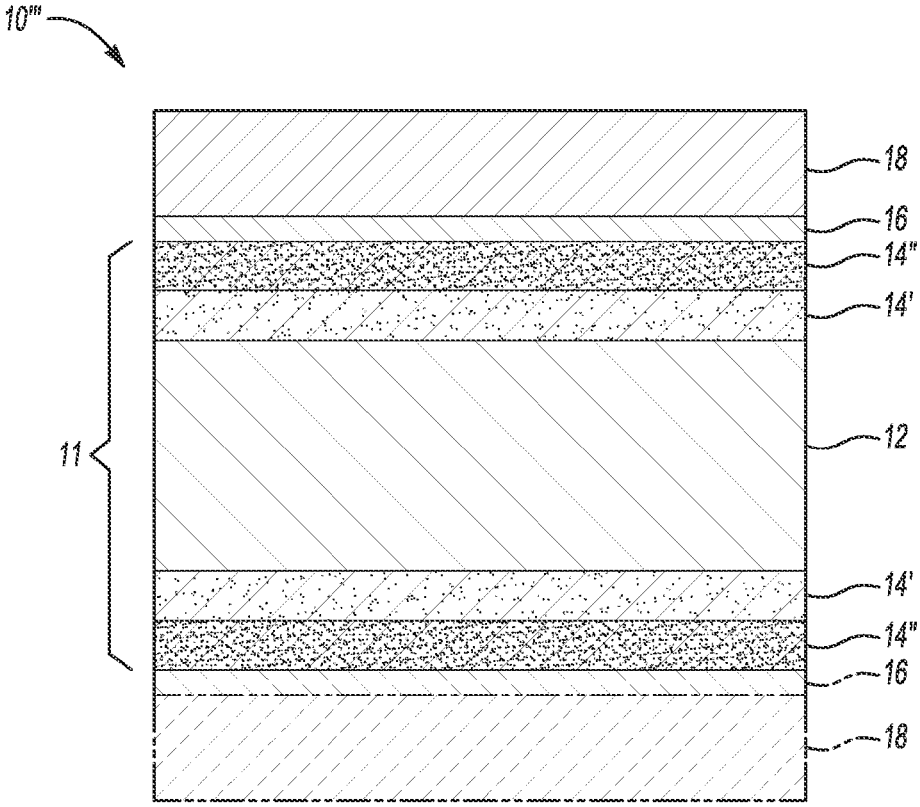
FIG. 4 is a cross-sectional view depicting still another example of the recording medium, which includes a core substrate having a precoat and a topcoat mineral layer on both opposed surfaces of a base, and also includes an adhesion layer and a surface treatment layer on one or both of the opposed surfaces.
Figure 5:
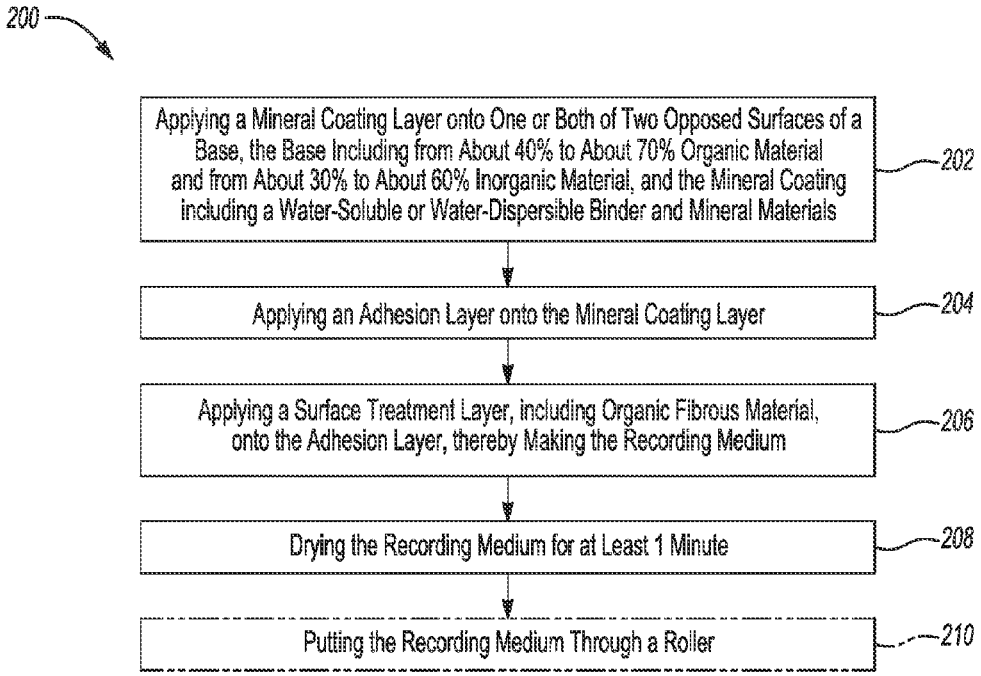
FIG. 5 is a flow diagram depicting an example of a method for making an example of the recording medium, where the adhesion layer and surface treatment layer are applied in separate layers onto the mineral coating layer of a core substrate.
Figure 6:
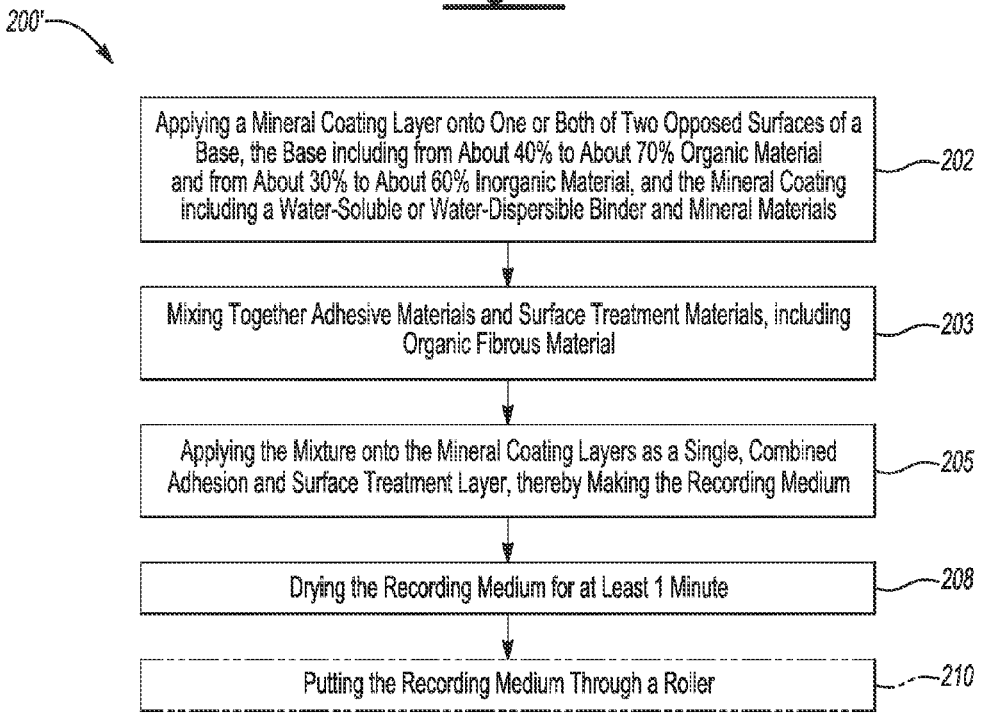
FIG. 6 is a flow diagram depicting another example of a method for making an example of the recording medium, where the adhesion layer and surface treatment layer are combined into a single layer and applied onto the mineral coating layer of a core substrate.

Various examples of the recording medium are shown in FIGS. 1 through 4. Examples of the method for making one or more examples of the recording medium are shown in FIGS. 5 and 6. Suitable materials that may be used for each of the various examples of the recording medium will be described, and then each of the specific layered structures as shown in FIGS. 1 through 4 and the methods shown in FIGS. 5 and 6 will be described.

Each of the examples of the recording medium disclosed herein includes a core substrate (shown as reference numeral 11 in FIGS. 1-4), which includes a base (shown as reference numeral 12 in FIGS. 1-4) and a mineral coating layer (shown as reference numeral 14 in FIGS. 1-3 and reference numerals 14' and 14" in FIG. 4) applied to one or both of the opposed surfaces of the base 12. The core substrate 11 has a basis weight ranging from about 30 g/m$^2$ (gsm) to about 350 g/m$^2$ (gsm).

Some examples of the core substrate 11 (i.e., the base 12 plus the mineral coating layer(s) 14 or 14' and 14") include coated graphic and packaging papers or boards that are commercially available, such as STERLING® Ultra Gloss (NewPage Corp.), Utopia 2 Matte or Utopia 2 Gloss (Appleton Coated). Other examples of the core substrate 11 may be made by applying the mineral coating layer(s) 14 or 14' and 14" to one or both surfaces of the base 12 (as will be discussed below).

In any of the examples disclosed herein, the base 12 includes from about 40% to about 70% of organic material. In addition, the base 12 includes inorganic material present in an amount ranging from about 30% to about 60%.

Examples of the organic materials that may be used in the base 12 disclosed herein may be cellulosic fibers. The cellulosic fibers may be natural fibers, virgin fibers, recycled fibers, non-deinkable fibers, unbleached fibers, synthetic fibers, mechanical fibers, or combinations thereof.

In an example, the organic materials include a blend of hardwood fibers and softwood fibers. Examples of suitable hardwood fibers include pulp fibers derived from deciduous trees (angiosperms), such as birch, aspen, oak, beech, maple, and eucalyptus. Examples of suitable softwood fibers include pulp fibers derived from coniferous trees (gymnosperms), such as varieties of fir, spruce, and pine (e.g., loblolly pine, slash pine, Colorado spruce, balsam fir, and Douglas fir). In an example, the base 12 includes a blend of International Paper northern USA hardwood fibers and International Paper southern USA softwood fibers. In an example, the ratio of hardwood fibers to softwood fibers used ranges from about 70/30 to about 60/40.

In an example, the blend of hardwood and softwood fibers includes virgin fibers, recycled fibers, and/or synthetic fibers. The blend of hardwood and softwood fibers may be prepared via any known pulping process, such as, for example, chemical pulping processes. In an example, the hardwood and softwood fibers are chemically pulped fibers. Two suitable chemical pulping methods include the kraft process and the sulphite process. In another example, some of the hardwood and softwood fibers are chemically pulped fibers, and some of the hardwood and softwood fibers are mechanically pulped fibers. In the latter example, the amount of chemically pulped fibers is at least 90 wt % of the total fiber content, and the amount of mechanically pulped fibers is up to 10 wt % of the total fiber content. "Wt %" as used herein refers to dry weight percentage based on the total dry weight of the fiber content.

Examples of the inorganic material that may be used in the base 12 include titanium dioxide ($TiO_2$), precipitated calcium carbonate, ground calcium carbonate, talc, clay (e.g., calcined clay, kaolin clay, or other phyllosilicates), zeolite, calcium sulfate, silicas, aluminas, or combinations thereof. In an example, a suitable inorganic material for the base 12 is a combination of precipitated calcium carbonate with kaolin clay.

Titanium dioxide is commercially available, for example, under the tradename TI-PURE® RPS VANTAGE® (E.I. du Pont de Nemours and Company). Precipitated calcium carbonate may be obtained by calcining crude calcium oxide. Water is added to obtain calcium hydroxide, and then carbon dioxide is passed through the solution to precipitate the desired calcium carbonate. Precipitated calcium carbonate is also commercially available, for example, under the tradenames OPACARB® A40 and ALBACAR® HO DRY (both of which are available from Minerals Technologies Inc.). Ground calcium carbonate is commercially available, for example, under the trade names OMYAFIL®, HYDROCARB 70®, and OMYAPAQUE®, all of which are available from Omya North America. Examples of commercially available clays are KAOCAL™, EG-44, and B-80, all of which are available from Thiele Kaolin Company. An example of commercially available talc is FINNTALC™ F03, which is available from Mondo Minerals.

Figure 1:
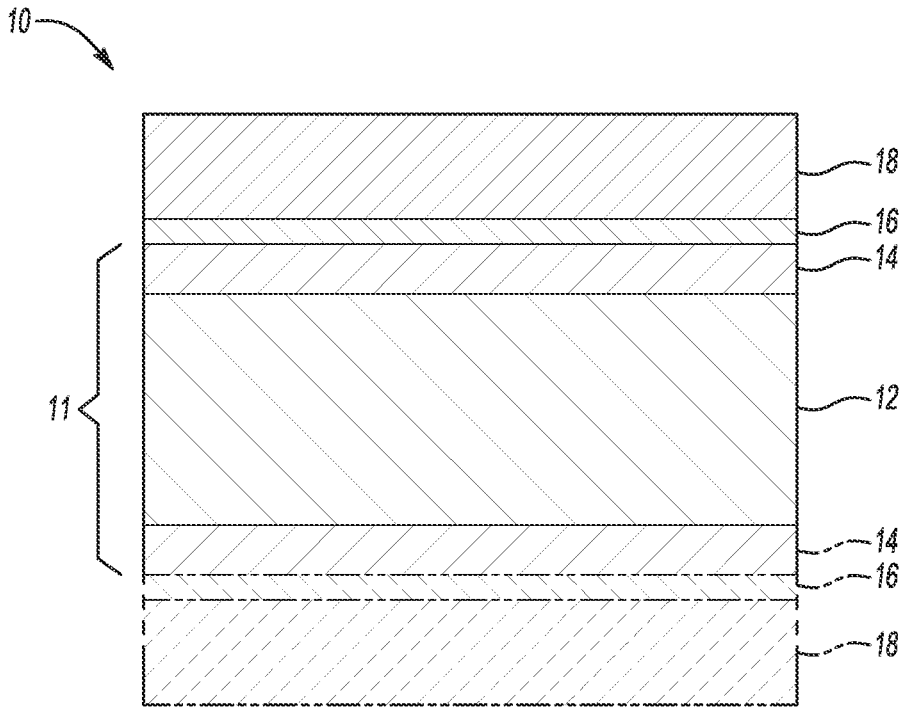
FIG. 1 is a cross-sectional view depicting an example of a recording medium, which includes a surface treatment layer, an adhesion layer, and a core substrate including a mineral coating layer on one or both opposed surfaces of a base.
Figure 2:
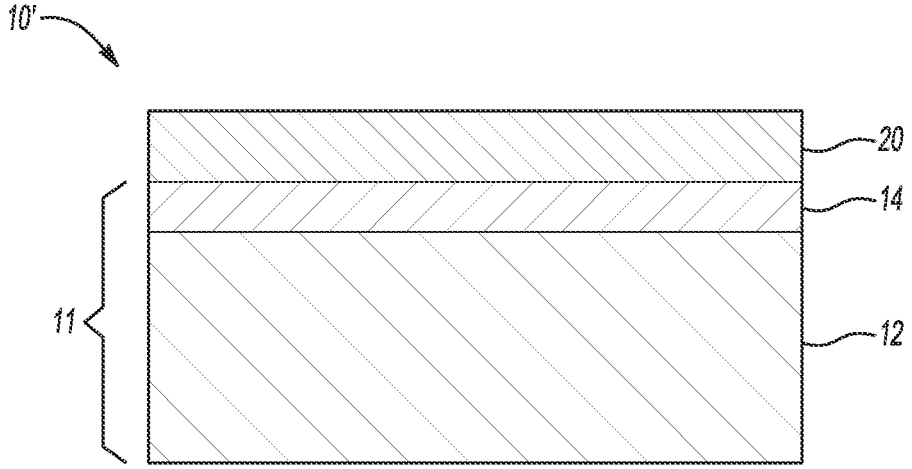
FIG. 2 is a cross-sectional view depicting another example of the recording medium, which includes a combined surface treatment and adhesion layer on one opposed surface of a core substrate including a base and a mineral coating layer.

Examples of the recording medium disclosed herein may further include the mineral coating layer 14 or 14' and 14" on one or both of the two opposed surfaces of the base 12. As shown in FIGS. 1-3, the mineral coating layer 14 may be a single layer, or as shown in FIG. 4, the mineral coating layer may be divided into a precoat layer 14' and a topcoat layer 14". The mineral coating layer 14 (or the combination of 14' and 14") has a basis weight ranging from about 10 $g/m^2$ (gsm) to about 60 $g/m^2$ (gsm), which contributes to the overall basis weight of the core substrate 11. The mineral coating layer, as the single layer 14 or the divided layers 14' and 14", may include a water-soluble or water-dispersible binder and mineral materials. The mineral coating layer 14 or 14' and 14" may additionally contain additives. In one instance, the mineral coating layer 14 or 14' and 14" may include up to about 90% of the mineral materials, up to 30% of the water-soluble or water-dispersible binder, and up to 5% of the mineral coating additives.

Examples of the water-soluble or water-dispersible binder in the mineral coating layer 14 or 14' and 14" may include polyvinyl alcohol (PVOH), starch, latex (e.g., styrene butadiene rubber, acrylates, etc.), or combinations thereof. It is to be understood that any of the previously listed examples of the inorganic material for the base 12 may be used as the mineral materials in the mineral coating layer 14 or 14' and 14". The additives that may be included in the mineral coating layer 14 or 14' and 14" include lubricants, dispersants, defoamers, buffering agents, or combinations thereof.

When the mineral coating layer is divided into the precoat 14' and topcoat 14", the various components may be divided between the two layers. In an example, when the mineral coating layer is divided into the precoat layer 14' and the topcoat layer 14', the precoat layer 14 may include starch, ground calcium carbonate, clays, and the other inorganic materials previously mentioned. The topcoat layer 14" may include clay, precipitated calcium carbonate, latex, and any of the other inorganic materials previously mentioned.

Examples of the recording medium disclosed herein may further include an adhesion layer (shown as reference numeral 16 in FIGS. 1, 3 and 4). The adhesion layer 16 has a basis weight ranging from about 1 $g/m^2$ (gsm) to about 25 $g/m^2$ (gsm). Said another way, the adhesion layer 16 has a thickness ranging from about 1 μm to about 25 μm. The adhesives in the adhesion layer 16 may be thermoplastic or thermosetting polymeric materials. Some examples of suitable adhesive materials for the adhesion layer 16 include polyvinyl alcohol or derivatives thereof, polyethylene glycol or derivatives thereof, polyurethane, polyvinyl acetate, melamine formaldehyde, urea formaldehyde, phenol formaldehyde, casein, animal glue, epoxy resins, polyvinylpyrrolidone, starch or derivatives thereof, gelatin or derivatives thereof, cellulose or derivatives thereof, maleic anhydride polymers or copolymers, acrylic ester polymer and copolymers, polymethylacrylate or copolymers thereof, polyacrylamide, latex resin materials, hot melts (e.g., ethylene-vinyl acetate (EVA) copolymers), or any combination thereof.

The latex resin materials may be derived from a number of monomers such as, for example, vinyl monomers, acrylic monomers, olefins, unsaturated hydrocarbons, and mixtures thereof. Classes of vinyl monomers may include vinyl aromatic monomers, vinyl aliphatic monomers (e.g., butadiene), vinyl alcohols, vinyl halides, vinyl esters of carboxylic acids (e.g., vinyl acetate), vinyl ethers, (meth)acrylic acid, (meth)acrylates, (meth)acrylamides, (meth)acrylonitriles, and mixtures of two or more of the above. Another example of the adhesive materials includes (meth)acrylic latex. The term "(meth)acrylic latex" includes polymers or copolymers of acrylic monomers (e.g., styrene acrylic, vinyl acrylics, etc.), polymers or copolymers of methacrylic monomers (e.g., styrene methylacrylate), and copolymers of the above-mentioned monomers with other monomers.

Examples of vinyl aromatic monomers that may form the latex polymeric adhesive material include styrene, 3-methylstyrene, 4-methylstyrene, styrene-butadiene, p-chloromethylstyrene, 2-chlorostyrene, 3-chlorostyrene, 4-chlorostyrene, divinyl benzene, vinyl naphthalene, and divinyl naphthalene. Examples of vinyl halides that may be used include vinyl chloride, and vinylidene fluoride. Examples of vinyl esters of carboxylic acids that may be used include vinyl acetate, vinyl butyrate, vinyl methacrylate, vinyl 3,4-dimethoxybenzoate, vinyl malate, and vinyl benzoate.

Examples of vinyl ethers that may be used include butyl vinyl ether and propyl vinyl ether.

In some examples, the adhesive material may be a polyvinyl alcohol, poly vinyl acetate, starch, or a combination of these materials. In some other examples, the adhesive material may be a styrene/butadiene latex copolymer, a styrene/butadiene/acrylonitrile latex copolymer, or a combination of these materials. Examples of suitable commercially available adhesive materials include MOWIOL®4-98 polyvinyl alcohol (Kuraray America, Inc.), Penford Gum® 280 (Penford Product Company), GENCRYL®9525 styrene/butadiene/acrylonitrile copolymer (from RohmNova), GENCRYL®9750 styrene/butadiene/acrylonitrile (from RohmNova), STR 5401 styrene/butadiene (from The Dow Chemical Company), or a combination of two or more of the above.

Examples of the recording medium disclosed herein may further include a surface treatment layer (shown as reference numeral 18 in FIGS. 1, 3 and 4). In an example, the surface treatment layer 18 has a basis weight ranging from about 5 $g/m^2$ (gsm) to about 100 $g/m^2$ (gsm) (i.e., a thickness ranging from about 5 μm to about 100 μm). In another example, the surface treatment layer 18 has a basis weight ranging from about 20 $g/m^2$ (gsm) to about 50 $g/m^2$ (gsm). In yet another example, the surface treatment layer 18 has a basis weight ranging from about 30 $g/m^2$ (gsm) to about 40 $g/m^2$ (gsm).

The surface treatment layer 18 includes organic fibrous material. Examples of the organic fibrous material may be chosen from the same example materials set forth herein for the organic material of the base 12.

The surface treatment layer 18 may further include a water soluble di-valent or multi-valent salt. The di-valent or multi-valent salt may include calcium chloride ($CaCl_2$), magnesium chloride ($MgCl_2$), aluminum chloride ($AlCl_3$), magnesium sulfate ($MgSO_4$), calcium acetate ($Ca(C_2H_3O_2)_2$) or combinations thereof.

The surface treatment layer 18 may further include one or more additives. These additives may include filler materials (which may be chosen from the same examples of inorganic materials used in the base 12 as disclosed above), dyes, optical brightening agents ("OBAs"), and/or adhesive materials (which may be chosen from the same examples of adhesive materials described above for the adhesion layer 16). It is to be understood that the OBAs and dyes may be added to alter the color of the outer surface of the examples of the recording medium disclosed herein.

In an example, the components of the surface treatment layer 18 may be combined with the components of the adhesion layer 16 and applied to the recording medium as a single layer (shown at reference numeral 20 in FIG. 2). In the single surface treatment and adhesion layer 20, the same type and amount of the components used in the separate layers 16 and 18 may be used in an example. As such, the single surface treatment and adhesion layer 20 may have a basis weight ranging from about 6 $g/m^2$ to about 125 $g/m^2$.

Depending upon the layering structure, the overall basis weight of the recording medium may range from about 46 $g/m^2$ (gsm) to about 500 $g/m^2$ (gsm). The lighter weight recording media may be more desirable for books, office printing, etc., while the heavier weight recording media may be more desirable for crafts, packaging, boards, structural papers, etc.

The specific layering structures that may be used in the different examples of the recording media will now be discussed in reference to FIGS. 1 through 4.

The example of the recording medium 10 shown in FIG. 1 includes the core substrate 11, which includes the base 12 with the mineral coating layer 14 disposed on one or both opposed surfaces of the base 12. In this example, the adhesion layer 16 is disposed on the mineral coating layer(s) 14, and the surface treatment layer 18 is disposed on the adhesion layer(s) 16.

FIG. 2 illustrates another example of the recording medium 10' disclosed herein. This example of the recording medium 10' includes the core substrate 11, which includes the base 12 with the mineral coating layer 14 disposed on one of the opposed surfaces of the base 12. In this example, the combined surface treatment and adhesion layer 20 is disposed on the mineral coating layer 14. While not shown, it is to be understood that the mineral coating layer 14 and the combined surface treatment and adhesion layer 20 may also be disposed on the other of the opposed surfaces of the base 12 so that both surfaces of the base 12 are coated.

FIG. 3 illustrates still another example of the recording medium 10" disclosed herein. The recording medium 10" shown in FIG. 3 includes the core substrate 11, which includes the base 12 and the mineral coating layer 14 disposed on both of the opposed surfaces thereof. In this example, the adhesion layer 16 and the surface treatment layer 18 are disposed on one of the mineral coating layers 14.

FIG. 4 depicts yet another example of the recording medium 10'" disclosed herein. This example of the recording medium 10'" includes the core substrate 11, which includes the base 12 with a precoat mineral coating layer 14' disposed on both of the opposed surfaces of the base 12. The topcoat mineral coating layer 14" is also disposed on each of the precoat mineral coating layer 14'. In this example, the adhesion layer 16 may be disposed on one or both of the topcoat mineral coating layers 14" that are present on the respective opposed surfaces of the base 12. The surface treatment layer 18 is disposed on the adhesion layer(s) 16.

FIG. 5 illustrates one example of the method 200 for making the recording medium. This example of the method 200 may be suitable for forming the recording medium 10, 10" and 10'". The method 200 includes a first step 202 of applying the mineral coating layer 14 onto one or both of the two opposed surfaces of the base 12. To form the recording medium 10 or 10", the mineral coating layer 14 is applied as a single layer. To form the recording medium 10'", the mineral coating layer is applied by first depositing the precoat 14' and then depositing the topcoat 14". Deposition of the mineral coating layer 14 or 14' and 14" may be accomplished using a blade coater, a rod coater, an air knife coater, a roll coater, a dip coater, a knife over roll coater, or a curtain coater.

The next step 204 in this example of the method 200 includes applying the adhesion layer 16 onto the mineral coating layer(s) 14 or onto the topcoat(s) 14". The adhesion layer 16 may be applied using an anilox roller, a flexo coater, a blade coater, a rod coater, an air knife coater, a roll coater, a dip coater, a knife over roll coater, a slot-die coater or a curtain coater.

The next step 206 of the method 200 includes applying the surface treatment layer 18 onto the adhesion layer(s) 16. The surface treatment layer 18 may be applied by a lamination process.

As shown at final step 208 of the method 200, the recording medium 10, 10" or 10'" is dried for at least one minute. The drying temperature may range anywhere from 40° C. to about 250° C., and drying may be accomplished by conduction, convection, or radiation. The method 200 may also include the step of taking the recording medium 10, 10" or 10'" and putting it through a roller, as shown at step 210.

The roller may be used to mechanically fix the outermost layer(s) to the intermediate layer(s) in order to provide a smooth surface for printing.

FIG. 6 illustrates another method 200' for making the recording medium. This example of the method 200' may be suitable for forming the recording medium 10'. This example of the method 200' includes a first step 202 of applying the mineral coating layer 14 onto one or both of two opposed surfaces of the base 12.

In this example of the method 200', the second step 203 involves mixing together adhesive materials (i.e., components suitable for forming adhesion layer 16) and surface treatment materials (i.e., components suitable for forming surface treatment layer 18). Mixing may be performed by manual mixing or automated mixing. In some instances, mixing may be performed while heating. In an example when PVA and/or starch are mixed together or with other materials, it may be desirable to heat, while mixing, to a temperature ranging from about 90° C. to about 95° C.

A third step 205 of the method 200' includes applying the mixture of the adhesive and surface treatment materials onto the mineral coating layer(s) 14 as a single, combined adhesion and surface treatment layer 20. The mixture may be applied using any of the methods previously described for depositing the adhesion layer 16 or the surface treatment layer 18.

Drying of the recording medium 10' may be performed as previously described at step 208 in FIG. 5, and the recording medium 10' may also be put through a roller as previously described at step 210 in FIG. 5.

The methods disclosed herein result in the recording media 10, 10', 10", 10'", which exhibit a desirable stiffness level without having to perform additional calendering. The desired stiffness level is due, at least in part, to the increased amount of inorganic material that is included. In addition, each of the recording media 10, 10', 10", 10'" may exhibit a porosity of 150 mL/min or less. The low porosity is a result of having a relatively high amount of inorganic material in the mineral coating layer 14 or 14' and 14" on the base 12. With low porosity, the mineral coating layer 14 or 14' and 14" acts as a barrier, so that subsequently applied ink does not penetrate the base 12, thereby reducing ink strikethrough.

While not shown in the figures, the recording medium 10, 10', 10", 10'" may also be formed by providing the core substrate 11 (i.e., which may be a commercially available coated paper product), and then applying the adhesion layer(s) 16 and surface treatment layer(s) 18 or the single adhesion and surface treatment layer 20 to the core substrate 11 using the deposition techniques set forth herein.

The examples of the recording medium 10, 10', 10", 10'" disclosed herein may be printed on using a variety of printing techniques, including laser printing, inkjet printing, liquid electrophotographic (LEP) printing, and flexographic printing. Printing may be accomplished in the typical manner, where the recording medium 10, 10', 10", 10'" is fed into the selected printer, and toner or ink is applied thereto.

To further illustrate the present disclosure, examples are given herein. It is to be understood that these examples are provided for illustrative purposes and are not to be construed as limiting the scope of the present disclosure.

EXAMPLES

Example 1

Three samples of the recording medium disclosed herein were prepared.

Sample 1 included a core substrate made up of a 100% recycled cellulosic fiber base (80 gsm) and a mineral coating layer (including 90 parts HYDROCARB® 90 (Omya), 8 parts ACRONAL® S728 latex (BASF) and 2 parts Penford Gum 280) (37.7 gsm) applied to both sides of the base. A polyvinyl alcohol adhesion layer (2.5 gsm) was applied to each of the mineral coating layers, and a surface treatment layer (consisting of HP Multipurpose paper with Colorlok® treatment (75 gsm)) was applied to each of the adhesion layers.

Sample 2 included the commercially available Silver Digital 150 gsm coated media (from M-real Zanders) as the core substrate. This core substrate included about 95 gsm of a base and about 55 gsm of a mineral coating on both sides of base. A polyvinyl alcohol adhesion layer (2.5 gsm) was applied to one of the mineral coating layers, and a surface treatment layer (consisting of HP Multipurpose paper with Colorlok® treatment (75 gsm)) applied to the adhesion layer.

Sample 3 included a core substrate made up of a cellulosic fiber core base (49 gsm) and a mineral coating layer (including 60 parts KAOCAL™ (Thiele Kaolin Co.), 40 parts OPACARB® A40 (Specialty Minerals Inc.), 12 parts latex, and 2 parts starch, and less than 2 parts of additives including optical brightening agents, defoamer, etc.) (21 gsm) applied to both sides of the base. A polyvinyl alcohol adhesion layer (2.5 gsm) was applied to one of the mineral coating layers, and a surface treatment layer (consisting of plain paper (48.5 gsm) was applied to the adhesion layer.

Along with the three samples of the recording medium, three comparative samples were also prepared. Each of the comparative samples used plain paper with no Colorlok® treatment. For comparative sample 1, two sheets of 152.5 gsm plain paper were used for the data measurements. For comparative sample 2, one sheet of 75.5 gsm plain paper and one sheet of 152.5 gsm plain paper were used for the data measurements. For comparative sample 3, two sheets of 75.5 gsm plain paper were used for the data measurements.

The recording medium samples and comparative samples had basis weight, caliper, bulk, strikethrough measurements, and ash content taken or calculated. Table 1 below shows the results.

TABLE 1

| Sample ID | Basis Weight (gsm) | Caliper (mils) | Bulk (cm3/g) | Strike-through (moD) | Weight Percent Ash at 550° C. (%) |
|---|---|---|---|---|---|
| Sample 1 | 317 | 13.6 | 1.09 | 72.33 | 38.2 |
| Comparative Sample 1 | 305 | 15.4 | 1.28 | 79.67 | 17.0 |
| Sample 2 | 230 | 8.9 | 0.98 | 55.00 | 33.7 |
| Comparative Sample 2 | 228 | 11.5 | 1.28 | 81.33 | 17.0 |
| Sample 3 | 142 | 6.0 | 1.07 | 52.67 | 33.3 |
| Comparative Sample 3 | 150.5 | 7.9 | 1.33 | 90.67 | 16.0 |

In this Example, the bulk was calculated from the basis weight and caliper data for each sample and comparative sample. The bulk=caliper/basis weight. A lower bulk number indicates denser media. A denser media is indicative of the presence of more inorganic material. The results shown in Table 1 indicate that even with a higher amount of inorganic material, the recording media maintain a desirable caliper and basis weight.

The strikethrough was determined using an XRite 939 with a density A setting to measure the black optical density on the opposite side of a printed solid area. A simplex test plot was printed on each of the samples and the comparative samples with a black solid area. The black solid area was placed print side down on a white backing. Optical density readings were taken on the back side of the sample or comparative sample in the area with solid black printing. Strikethrough was measured as mOD by multiplying optical density (KOD) by 1000. A lower mOD number indicates a lower strikethrough (i.e., the amount of printed ink on one side of a paper than can be seen through the other side of the paper). A lower strikethrough means that less of the printed image is seen through the paper, and that the paper has better opacity and a better duplex print quality.

As shown in Table 1, the recording medium samples when compared to their respective comparative samples had a lower strikethrough number and bulk number. This demonstrates that the recording medium samples had an improved duplex print quality and an improved density when compared to their respective comparative samples.

In addition, the weight percent ash values were determined to reflect the inorganic content of each recording medium. The weight percent ash values were determined using Thermogravimetric analysis ("TGA"). The samples and comparative samples were burned at 550° C., and a weight of the ash in milligrams ("mg") was taken along with the initial weight (in mg) of the test specimen at 150° C. The ash content in percent ("%")=A*100/B, where A is the weight of ash at 550° C. in mg and B is the initial weight of the test specimen at 150° C. in mg. The higher the ash content, the more inorganic material the recording medium contained.

As shown in Table 1, each of the samples had about double the ash content of their respective comparative samples. This demonstrates that the recording medium samples had a higher content of inorganic material and lower content of organic material in the base when compared to their respective comparative samples.

Example 2

Sample 2 from Example 1 was tested for bonding of the surface treatment layer to the core substrate by tearing the media. The sample exhibited excellent bonding, as indicated by the fact that sample tore between the base and the mineral coating layer. Poor bonding would result in a tear between the surface treatment layer and the core substrate, which did not occur in this test of the recording medium.

This sample also had the look and feel of plain paper, which was desirable.

Reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

It is to be understood that the ranges provided herein include the stated range and any value or sub-range within the stated range. For example, a range from about 5 g/m$^2$ (gsm) to about 100 g/m$^2$ (gsm) should be interpreted to include not only the explicitly recited limits of about 5 g/m$^2$ (gsm) to about 100 g/m$^2$ (gsm), but also to include individual values, such as 15 gsm, 45 gsm, 90 gsm, etc., and sub-ranges, such as from about 25.5 gsm to about 95 gsm, from about 40 gsm to about 60 gsm, etc. Furthermore, when "about" is utilized to describe a value, this is meant to encompass minor variations (up to +/−10%) from the stated value.

While several examples have been described in detail, it will be apparent to those skilled in the art that the disclosed examples may be modified. Therefore, the foregoing description is to be considered non-limiting.

What is claimed is:

1. A recording medium, comprising:
- a core substrate, including:
  - a base having two opposed surfaces, the base including: from about 40% to about 70% organic material; and from about 30% to about 60% inorganic material; and
  - a mineral coating layer disposed on one or both of the two opposed surfaces, the mineral coating including: up to about 30% of a water-soluble or water-dispersible binder selected from the group consisting of polyvinyl alcohol, starch, acrylate latexes, and combinations thereof; and up to about 90% of mineral materials;
- an adhesion layer disposed on the mineral coating layer of the core substrate; and
- a surface treatment layer disposed on the adhesion layer, the surface treatment layer including organic fibers.

2. The recording medium as defined in claim 1 wherein the adhesion layer and the surface treatment layer are combined into a single layer disposed on the mineral coating layer.

3. The recording medium as defined in claim 1 wherein the recording medium has a porosity of less than about 150 mL/min.

4. The recording medium as defined in claim 1 wherein the recording medium exhibits a strikethrough equal to or less than 75 moD and a bulk equal to or less than 1.25 cm$^3$/g.

5. The recording medium as defined in claim 1 wherein:
- the core substrate has a basis weight ranging from about 30 gsm to about 350 gsm;
- the adhesion layer has a basis weight ranging from about 1 gsm to about 25 gsm; and
- the surface treatment layer has a basis weight ranging from about 5 gsm to about 100 gsm.

6. The recording medium as defined in claim 1 wherein the surface treatment layer organic fibers are chosen from non-wood fibers, wood fibers, recycled non-wood or wood fibers, and combinations thereof, and wherein the base organic material is chosen from a blend of hardwood and softwood fibers, the blend including virgin fibers, recycled fibers, synthetic fibers, or a mixture of virgin recycled and synthetic fibers.

7. The recording medium as defined in claim 1 wherein the adhesion layer includes an adhesive material chosen from thermoplastic or thermoset polymeric adhesive materials.

8. The recording medium as defined in claim 1 wherein the surface treatment layer further includes a water soluble di-valent or multi-valent salt.

9. The recording medium as defined in claim 8 wherein the water soluble di-valent or multi-valent salt is chosen from calcium chloride ($CaCl_2$), magnesium chloride ($MgCl_2$), aluminum chloride ($AlCl_3$), magnesium sulfate ($MgSO_4$), calcium acetate ($Ca(C_2H_3O_2)_2$), and combinations thereof.

10. The recording medium as defined in claim 1 wherein the surface treatment layer further includes additives.

11. The recording medium as defined in claim 10 wherein the additives are chosen from filler materials, dyes, optical brightening agents (OBAs), and adhesive materials.

12. The recording medium as defined in claim 1 wherein the mineral coating layer further includes up to about 5% of mineral coating additives, the mineral coating additives being chosen from lubricants, dispersants, defoamers, buffering agents, and combinations thereof.

13. The recording medium as defined in claim 1 wherein the mineral materials are chosen from clays, silicas, titanium dioxide, precipitated calcium carbonate, ground calcium carbonate, talc, calcium sulfate, and combinations thereof.

14. A method for making a recording medium, comprising:

applying a mineral coating layer onto one or both of two opposed surfaces of a base, the base including:

from about 40% to about 70% organic material; and from about 30% to about 60% inorganic material;

the mineral coating including:

up to about 30% of a water-soluble or water-dispersible binder selected from the group consisting of polyvinyl alcohol, starch, acrylate latexes, and combinations thereof; and up to about 90% of mineral materials;

applying an adhesion layer onto the mineral coating layer;

applying a surface treatment layer, including organic fibers, onto the adhesion layer, thereby making the recording medium; and then drying the recording medium for at least 1 minute.

15. The method as defined in claim 14 wherein, instead of applying the adhesion layer and the surface treatment layer separately, respective materials comprising the adhesion layer and the surface treatment layer are mixed together, and the mixed materials are applied onto the mineral coating layer as a single, combined adhesion and surface treatment layer.

16. The recording medium as defined in claim 1 wherein the mineral coating includes about 90% of the mineral materials.

17. The method as defined in claim 14 wherein the mineral coating includes about 90% of the mineral materials.

* * * * *